US011185165B2

(12) United States Patent
Chen et al.

(10) Patent No.: US 11,185,165 B2
(45) Date of Patent: Nov. 30, 2021

(54) ARMCHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 17/017,734

(22) Filed: Sep. 11, 2020

(65) Prior Publication Data

US 2021/0219724 A1 Jul. 22, 2021

(30) Foreign Application Priority Data

Jan. 21, 2020 (CN) ..... 202010071006.3
Jan. 21, 2020 (CN) ..... 202020140681.2
Jun. 9, 2020 (CN) ..... 202010519073.7
Jun. 9, 2020 (CN) ..... 202021061728.2

(51) Int. Cl.

| | |
|---|---|
| ***A47C 1/032*** | (2006.01) |
| ***A47C 1/034*** | (2006.01) |
| ***A47C 4/30*** | (2006.01) |
| ***A47C 7/50*** | (2006.01) |
| ***A47C 20/04*** | (2006.01) |
| ***A47C 7/54*** | (2006.01) |
| ***A47C 1/0355*** | (2013.01) |

(52) U.S. Cl.
CPC ..... *A47C 1/03272* (2013.01); *A47C 1/0355* (2013.01); *A47C 7/541* (2018.08)

(58) Field of Classification Search
CPC ..... A47C 1/032; A47C 1/03244; A47C 1/03272; A47C 1/0342; A47C 1/035; A47C 1/0355; A47C 7/541
USPC ..... 297/19, 21, 27, 30, 38
See application file for complete search history.

(56) References Cited

U.S. PATENT DOCUMENTS 4,072,341 A * 2/1978 Kurz ..... A47C 1/035 267/179
4,898,421 A * 2/1990 Brunn ..... A47C 1/0265 297/28

(Continued)

FOREIGN PATENT DOCUMENTS

EP 172116 A * 2/1986 ..... A47C 1/03244
EP 399893 A * 11/1990 ..... A47C 1/03244

(Continued)

*Primary Examiner* — Rodney B White
(74) *Attorney, Agent, or Firm* — Bayramoglu Law Offices LLC

(57) ABSTRACT

An armchair includes a base, a backrest pivotally connected to the base by a first rotating shaft, an armrest connected to the base and an elastic assembly fixed on the armrest. The backrest and the elastic assembly are pivotally connected by a second rotating shaft. The elastic assembly is configured to provide elastic force when the backrest swings around the first rotating shaft. The elastic assembly arranged between the backrest and the armrest permits the backrest to be able to swing relative to the base. In use, the elastic assembly controls the swing amplitude of the backrest according to the pressure exerted by the user's back on the backrest. When the user reclines backward, the elastic assembly acts as a cushion to support the backrest to slowly swing backward due to the elastic force. When the user rises, the elastic force of the elastic assembly urges the backrest to reset.

18 Claims, 15 Drawing Sheets

(56) References Cited

U.S. PATENT DOCUMENTS 5,464,270 A * 11/1995 Chang ..... A47C 1/035 297/28
5,570,926 A * 11/1996 Papiernik ..... A47C 1/035 297/27
6,030,032 A * 2/2000 Tseng ..... A47C 1/027 297/28
6,382,727 B1 * 5/2002 Pickard ..... A47C 7/506 297/30
6,502,899 B2 * 1/2003 Tseng ..... A47C 1/0265 297/28
6,692,068 B1 * 2/2004 Tang ..... A47C 1/035 297/16.2
6,902,231 B1 * 6/2005 Tseng ..... A47C 1/0325 297/27
7,950,734 B2 * 5/2011 Zheng ..... A47C 1/03244 297/28
8,251,442 B2 * 8/2012 Grace ..... A47C 4/50 297/45
8,864,220 B2 * 10/2014 Kim ..... A47C 1/0342 297/19
8,905,471 B2 * 12/2014 Tang ..... A47C 7/624 297/173
9,089,220 B2 * 7/2015 Weng ..... A47C 7/54
2020/0305608 A1 * 10/2020 Grace ..... A47C 1/0265

FOREIGN PATENT DOCUMENTS

JP S5824246 U 2/1983
JP 2013162950 A 8/2013
KR 20090061126 A 6/2009
KR 2020000144 U * 1/2020 ..... A47C 1/03244
NL 7314394 A * 4/1974 ..... A47C 1/03244

* cited by examiner

ARMCHAIR

CROSS REFERENCE TO THE RELATED APPLICATIONS

This application is based upon and claims priority to Chinese Patent Application No. 202020140681.2, filed on Jan. 21, 2020; Chinese Patent Application No. 202010071006.3, filed on Jan. 21, 2020; Chinese Patent Application No. 202021061728.2, filed on Jun. 9 2020; and Chinese Patent Application No. 202010519073.7, filed on Jun. 9 2020; the entire contents of which are incorporated herein by reference.

TECHNICAL FIELD

The present invention relates to the technical field of seats, and more particularly, to an armchair.

BACKGROUND

A chair is a type of seat and frequently used in people's daily lives. A chair generally includes a backrest, a chair seat and armrests. People feel more comfortable when sitting on the chair while reclining on the backrest. To enhance this comfort, it is highly desirable to allow the backrest to swing, or adjustably recline, within a certain amplitude to satisfy people of different stature, weights, and sitting positions. Reclining backrests cannot be incorporated into some chairs, such as wooden chairs, however, due generally to the restriction of the chair being formed from wood. Certain metal and plastic chairs may have a backrest capable of swinging within an extremely small amplitude because the chair material has a certain elasticity. Such an extremely small amplitude, however, cannot achieve optimal user comfort. Besides, some chairs are transformed into rocking chairs by altering the legs to improve comfort. These chairs, however, have an altogether different style and thus cannot meet the diverse needs of the market.

SUMMARY

In view of the above-mentioned technical problems, an objective of the present invention is to provide a chair with a backrest that can swing, or adjustably recline, within a certain amplitude to offer enhanced comfort. Specifically, the present invention provides an armchair with an elastic assembly, and the elastic assembly enables the backrest to swing, or adjustably recline, within a certain amplitude and provides an elastic force when swinging.

To solve the above-mentioned technical problems, the present invention adopts the following technical solutions. An armchair includes a base, a backrest pivotally connected to the base by a first rotating shaft, and an armrest connected to the base. The armchair further includes an elastic assembly fixed on the armrest. The backrest and the elastic assembly are pivotally connected by a second rotating shaft. The elastic assembly is configured to provide an elastic force when the backrest swings around the first rotating shaft.

Preferably, the elastic assembly includes a connecting rod, a spring, a first sleeve and a first limiting member.

The first sleeve fixed on the armrest has a cavity with an open end and a closed end. One end of the connecting rod is pivotally connected to the backrest by the second rotating shaft. The connecting rod and the backrest are respectively rotatably connected to the second rotating shaft. The other end of the connecting rod is fixedly connected to the first limiting member and inserted into the cavity of the first sleeve. A protrusion is arranged inside the cavity of the first sleeve. The spring is sleeved on the connecting rod and located between the protrusion and the first limiting member. When the first limiting member moves toward the open end, the spring is compressed by the protrusion and the first limiting member.

Preferably, the elastic assembly further includes a second limiting member. The second limiting member is arranged between the first limiting member and the protrusion, and slidably fitted with the connecting rod. The spring is located between the first limiting member and the second limiting member. When the first limiting member moves toward the open end, the spring is compressed by the first limiting member and the second limiting member, and the protrusion restricts a movement of the second limiting member.

Specifically, the backrest includes a backrest rod, the end of the backrest rod is pivotally connected to the base by the first rotating shaft. One end of the connecting rod is pivotally connected to the backrest rod by the second rotating shaft.

In another embodiment of the armchair, the elastic assembly includes a spring, a second sleeve and a connecting member.

The second sleeve fixed on the armrest has a cavity, and the spring is arranged in the cavity of the second sleeve. The connecting member is located at one end of the spring and can move in the cavity along a direction in which the spring is compressed and stretched. The connecting member is pivotally connected to the backrest by the second rotating shaft, and the connecting member is rotatably connected to the second rotating shaft. The second sleeve is provided with a first channel, and the length direction of the first channel is parallel to the axis of the spring and perpendicular to the second rotating shaft. The first end of the second rotating shaft penetrates the connecting member and the first channel, and is rotatably connected to the backrest.

Preferably, the second sleeve is provided with a second channel, wherein the second channel and the first channel are symmetrically arranged. The second end of the second shaft penetrates the connecting member and the second channel.

Preferably, the contour of the first channel and/or the second channel is a closed curved surface.

Preferably, the armrest is provided with two third channels that are symmetrically arranged. The two third channels correspond to the first channel and the second channel, respectively. The length direction of the third channel is parallel to the axis of the spring and perpendicular to the second rotating shaft.

Two ends of the second rotating shaft pass through the two third channels, respectively.

Preferably, the contour of the third channel is a closed curved surface.

Specifically, the backrest includes a backrest rod, the end of the backrest rod is pivotally connected to the base by the first rotating shaft, and the connecting member is pivotally connected to the backrest rod by the second rotating shaft.

In another embodiment of the armchair, the elastic assembly includes a connecting rod, a third limiting member, a fourth limiting member, a fifth limiting member, a front spring and a rear spring. The third limiting member is fixedly connected to the armrest. One end of the connecting rod is pivotally connected to the backrest by the second rotating shaft. The other end of the connecting rod passes through the third limiting member and is fixedly connected to the fourth limiting member. The third limiting member is slidably fitted with the connecting rod. The fifth limiting member located between the third limiting member and the fourth limiting member is slidably fitted with the connecting rod. The front spring is sleeved on the connecting rod and located between the fourth limiting member and the fifth limiting member. The rear spring is sleeved on the connecting rod and located between the third limiting member and the fifth limiting member. The stiffness coefficient of the rear spring is greater than the stiffness coefficient of the front spring. When the fourth limiting member moves toward the third limiting member, the front spring is compressed by the fourth limiting member and the fifth limiting member, and the rear spring is compressed by the fifth limiting member and the third limiting member.

Preferably, the armrest has a first adjusting part, and the base includes a second adjusting part connected to the first adjusting part.

The first adjusting part cooperates with the second adjusting part, so that the armrest can move relative to the base and can be locked at a plurality of positions.

The backrest is linked with the armrest, and when the armrest is locked at different positions, the backrest rotates to a corresponding inclined angle.

Preferably, the second adjusting part is a locking pin, and the first adjusting part has an adjusting cavity enclosed by a surface. The locking pin is inserted into the adjusting cavity. The adjusting cavity includes a fourth channel in which the locking pin moves and a plurality of recesses in which the locking pin is embedded. The surface forming the recesses is configured to lock the locking pin.

Preferably, the elastic assembly further includes a third sleeve and an engaged key. The third sleeve fixed on the armrest has a cavity. One end of the cavity is an opening, and the other end of the cavity is provided with a blocking member. The third sleeve is provided with a limiting hole adjacent to the opening, and the third limiting member is provided with a limiting slot.

One end of the connecting rod fixed to the fourth limiting member is inserted into the cavity of the third sleeve from the opening and stopped by the blocking member. The engaged key is inserted into the limiting hole and the limiting slot.

Preferably, the backrest includes a backrest rod, and the backrest rod is pivotally connected to the base by a first rotating shaft. One end of the connecting rod is pivotally connected to the backrest rod by the second rotating shaft.

Preferably, the armchair further includes a footrest, and the footrest includes a side supporting rod with an end pivotally connected to the base. The end of the backrest rod is connected to the side supporting rod by a linkage rod, and both ends of the linkage rod are pivotally connected to the side supporting rod and the backrest rod, respectively.

The advantages of the present invention are as follows. This armchair is provided with the elastic assembly between the backrest and the armrest, whereby the backrest can swing, or adjustably recline, relative to the base. Moreover, the elastic assembly can provide a certain elastic force when the backrest swings. In use, the elastic assembly controls the swing amplitude of the backrest according to the pressure exerted by the user's back on the backrest. When the user reclines backward, the elastic assembly acts as a cushion to support the backrest to slowly swing, or adjustably recline, backward due to the elastic force. When the user rises, the elastic force of the elastic assembly urges the backrest to reset. In this way, the comfort of this armchair is significantly improved.

BRIEF DESCRIPTION OF THE DRAWINGS

The present invention will be further described hereinafter with reference to the drawings and embodiments.

In the figures: 1, first rotating shaft; 2, armrest; 3, front supporting leg; 4, rear supporting leg; 5, middle frame; 6, first hinge member; 7, backrest rod; 8, second hinge member; 9, connecting rod; 10, spring; 11, first sleeve; 12, first limiting member; 13, second limiting member; 14, second rotating shaft; 15, second sleeve; 16, connecting member; 17, first channel; 18, second channel; 19, flange; 20, third channel; 11-1, first cylindrical cavity; 11-2, second cylindrical cavity; 11-3, protrusion; 21, third sleeve; 22, engaged key; 23, third limiting member; 24, fourth limiting member; 25, fifth limiting member; 26, front spring; 27, rear spring; 28, limiting slot; 29, adjusting cavity; 29-1, fourth channel; 29-2, recess; 30, side supporting rod; 31, footrest rod; 32, linkage rod; 33, locking pin; 34, blocking member.

DETAILED DESCRIPTION OF THE EMBODIMENTS

Figure 1:
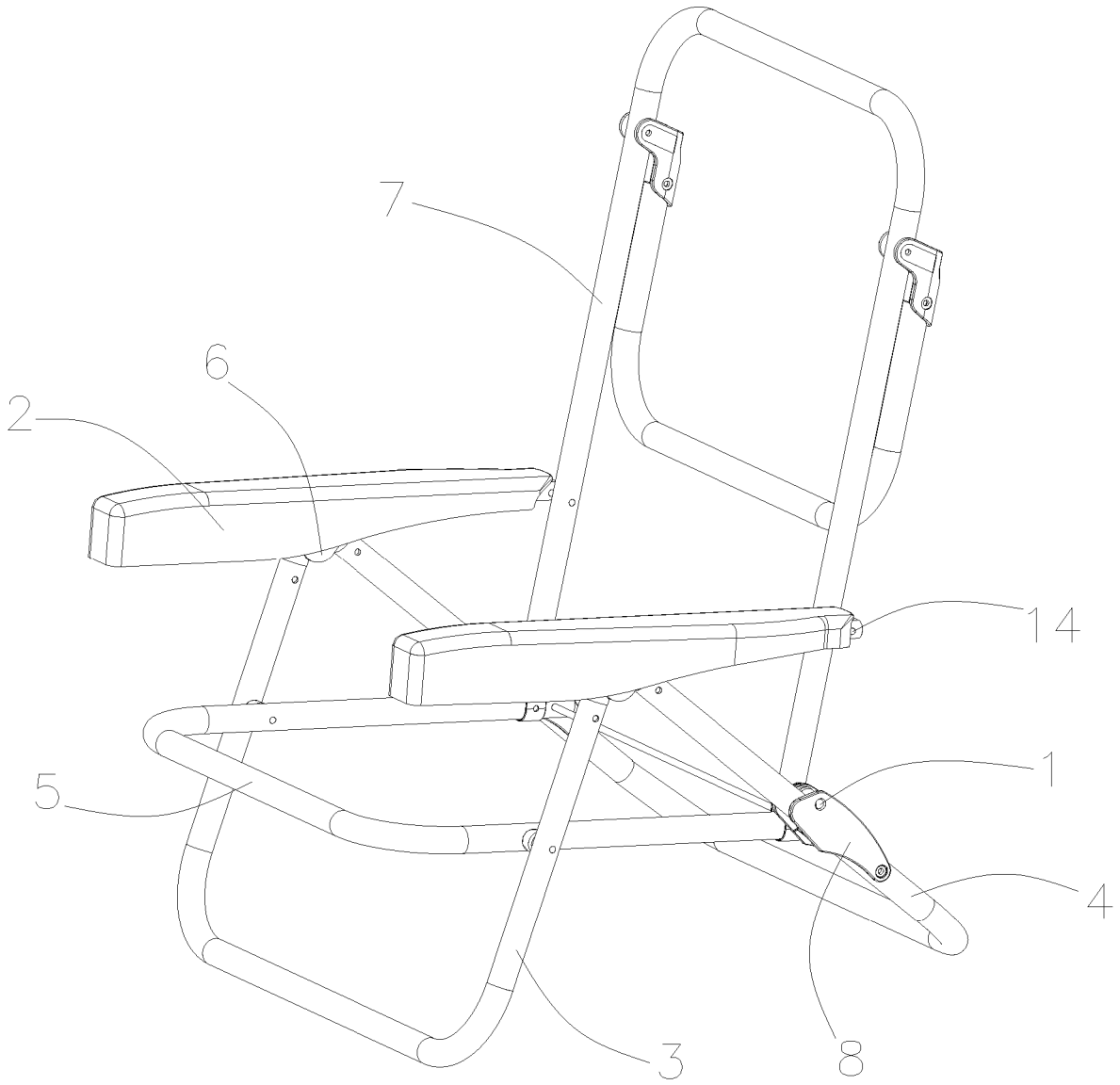
FIG. 1 is a schematic view of the frame structure of Embodiment 1 of the armchair.
Figure 2:
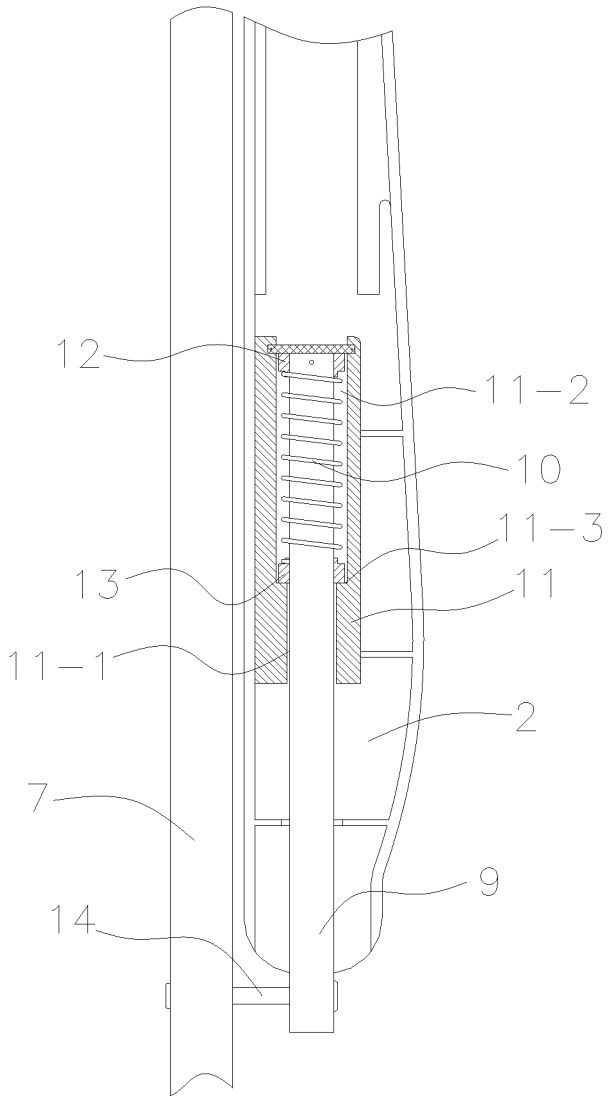
FIG. 2 is a partial structural schematic view of Embodiment 1 of the armchair.

FIGS. 1-2 schematically show Embodiment 1 of an armchair, which includes a base, a backrest pivotally connected to the base by the first rotating shaft 1, and the armrest 2 connected to the base. In the present embodiment, the armchair is a folding chair. The base includes the front supporting leg 3, the rear supporting leg 4 and the middle frame 5. The first hinge member 6 is arranged on the armrest 2. The first hinge member 6 is fixedly connected to the armrest and cannot move relative to the armrest. Alternatively, the first hinge member is connected to the armrest in a slidable manner, and can be locked at multiple positions within the sliding stroke to adjust the position of the first hinge member on the armrest. The upper ends of the front supporting leg 3 and the rear supporting leg 4 are pivotally connected to the first hinge member 6. The front supporting leg 3 and the rear supporting leg 4 support the armrest 2 when the armchair is unfolded. The backrest includes two backrest rods 7 symmetrically arranged. The second hinge member 8 is pivotally connected to the rear supporting leg 4. The end of the backrest rod 7 is pivotally connected to the second hinge member 8 by the first rotating shaft 1.

Two elastic assemblies are arranged on the two armrests 2, respectively. The elastic assembly includes the connecting rod 9, the spring 10, the first sleeve 11, the first limiting member 12 and the second limiting member 13. The first sleeve 11 fixed on the armrest 2 and has a cavity with an open end and a closed end. In the present embodiment, one end of the cavity is sealed by a sealing piece to facilitate assembly. The cavity includes the first cylindrical cavity 11-1 and the second cylindrical cavity 11-2 that communicate with each other. The cross-sectional diameter of the first cylindrical cavity 11-1 connected to the open end is smaller than the cross-sectional diameter of the second cylindrical cavity 11-2 so that the protrusion 11-3 is formed at the junction between the first cylindrical cavity 11-1 and the second cylindrical cavity 11-2. One end of the connecting rod 9 is pivotally connected to the backrest rod 7 by the second rotating shaft 14. The second rotating shaft 14 is located between the two ends of the backrest rod 7. Both the connecting rod 9 and the backrest rod 7 can rotate on the second rotating shaft 14. The other end of the connecting rod 9 is fixedly connected to the first limiting member 12 and inserted into the second cylindrical cavity 11-2 after passing through the first cylindrical cavity 11-1. The second limiting member 13 is arranged between the two ends of the connecting rod 9 and slidably fitted with the connecting rod 9. The spring 10 is sleeved on the connecting rod 9 and located between the first limiting member 12 and the second limiting member 13. The cross-sectional diameter of the first cylindrical cavity 11-1 is slightly larger than the cross-sectional diameter of the connecting rod 9, so that the connecting rod 9 can move along the axial direction of the first cylindrical cavity 11-1, and the first cylindrical cavity 11-1 can restrict a radial movement of the connecting rod 9. The outer diameter of the first limiting member 12 is slightly smaller than the diameter of the second cylindrical cavity 11-2. The outer diameter of the second limiting member 13 is slightly smaller than the diameter of the second cylindrical cavity 11-2 and larger than the diameter of the first cylindrical cavity 11-1. The outer diameter of the second limiting member 13 and the outer diameter of the first limiting member 12 are both larger than the outer diameter of the spring 10. When the user sits on the armchair and reclines on the backrest, the backrest swings backward around the first rotating shaft 1. The connecting rod 9 is pulled out by the second rotating shaft 14 from the open end, the first limiting member 12 also moves toward the open end, and the second limiting member 13 abuts on the protrusion 11-3 and thus cannot move. The spring 10 is compressed by the first limiting member 12 and the second limiting member 13 to provide an elastic force for the backrest. When the user rises, the restoring force of the spring 10 urges the backrest to reset. In other embodiments, the second limiting member 13 is removed, and one end of the spring 10 directly abuts on the protrusion 11-3.

In other embodiments, the first limiting member 12 is at the initial position when abutting on the closed end of the second cylindrical cavity 11-2. When the spring 10 is compressed in the limit state, the first limiting member 12 is in the limit position. The angle by which the backrest can swing, or adjustably recline, is determined by the distance between the initial position and the limit position of the first limiting member 12. In the present embodiment, when the spring 10 is in a relaxed state or slightly compressed state, the first limiting member 12 abuts against the closed end of the second cylindrical cavity 11-2, and the second limiting member 13 abuts against the protrusion 11-3. In this way, the backrest can obtain the elastic force provided by the elastic assembly in the entire swing amplitude.

According to other embodiments, both ends of the spring 10 are fixedly connected to the first limiting member 12 and the second limiting member 13, respectively.

Figure 3:
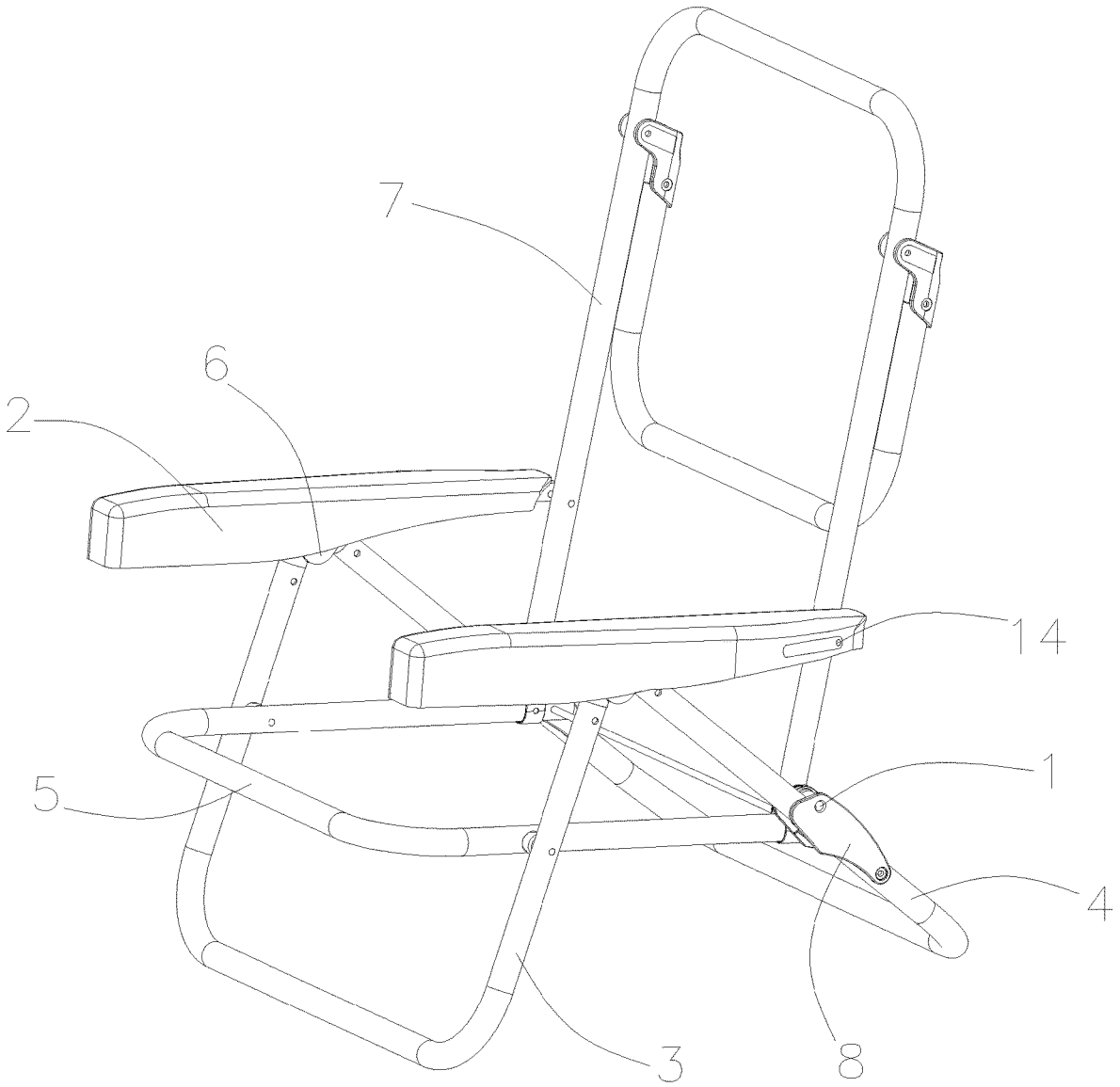
FIG. 3 is a schematic view of the frame structure of Embodiment 2 of the armchair.
Figure 4:
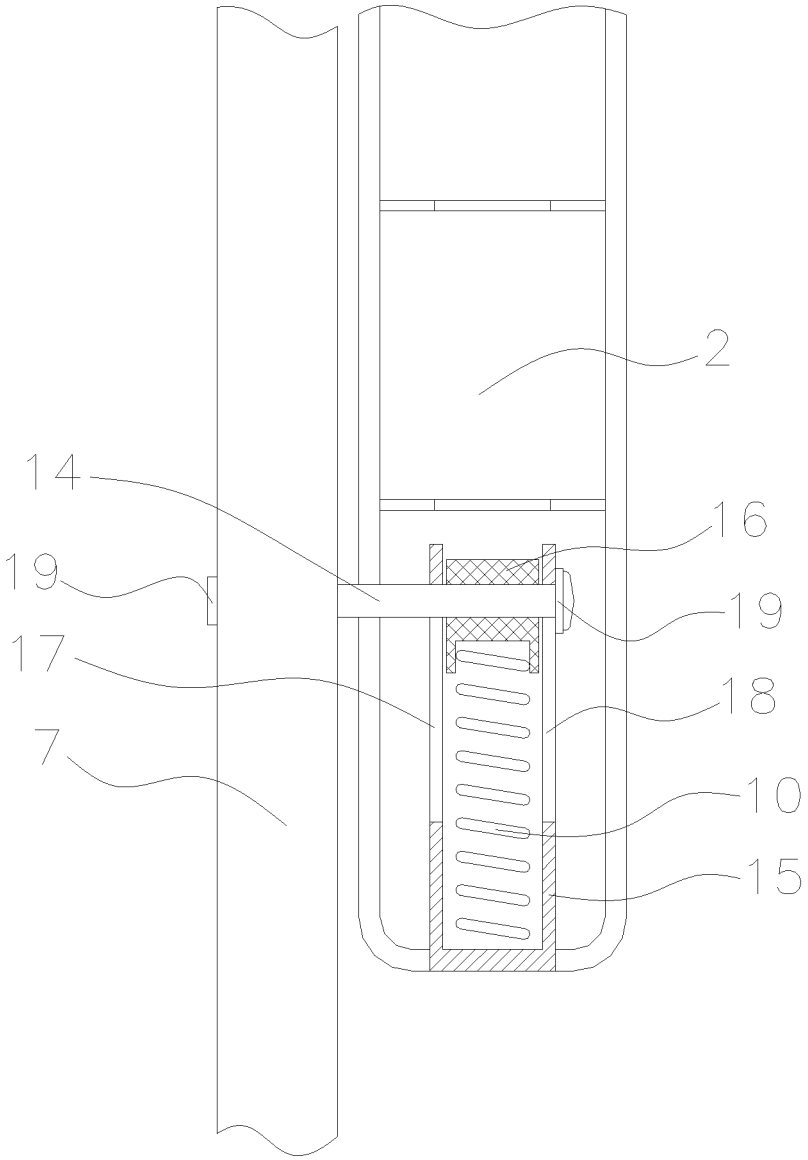
FIG. 4 is a partial structural schematic view of Embodiment 2 of the armchair.

FIGS. 3-4 schematically show Embodiment 2 of this armchair, which includes a base, a backrest pivotally connected to the base by the first rotating shaft 1, and the armrest 2 connected to the base. In the present embodiment, the armchair is a folding chair. The base includes the front supporting leg 3, the rear supporting leg 4 and the middle frame 5. The first hinge member 6 is arranged on and fixedly connected to the armrest 2 and cannot move relative to the armrest. Alternatively, the first hinge member is connected to the armrest in a slidable manner, and can be locked at multiple positions within the sliding stroke to adjust the position of the first hinge member on the armrest. The upper ends of the front supporting leg 3 and the rear supporting leg 4 are pivotally connected to the first hinge member 6. The front supporting leg 3 and the rear supporting leg 4 support the armrest 2 when the armchair is unfolded. The backrest includes two backrest rods 7 symmetrically arranged. The second hinge member 8 is pivotally connected to the rear supporting leg 4. The end of the backrest rod 7 is pivotally connected to the second hinge member 8 by the first rotating shaft 1.

In the present embodiment, the elastic assembly includes the spring 10, the second sleeve 15 and the connecting member 16. The second sleeve 15 fixed on the armrest 2 has a cylindrical cavity. The spring 10 is arranged in the cylindrical cavity of the second sleeve 15 and can be compressed and stretched in the cylindrical cavity. The connecting member 16 is located at one end of the spring 10 and can move in the cylindrical cavity. Both ends of the second rotating shaft 14 respectively penetrate both ends of the connecting member 16 and the connecting member 16 can rotate on the second rotating shaft 14. The second rotating shaft 14 is perpendicular to the direction in which the spring 10 is compressed and stretched, that is, perpendicular to the axis of the spring 10. The second sleeve 15 is provided with the first channel 17 and the second channel 18, wherein the first channel 17 and the second channel 18 are symmetrically arranged and have a length direction that is parallel to the direction in which the spring 10 is compressed and stretched. The width of each of the second channel 18 and the first channel 17 is slightly larger than the cross-sectional diameter of the second rotating shaft 14. The first end of the second rotating shaft 14 passes through the first channel 17 and then penetrates the backrest rod 7. The backrest rod 7 can rotate on the second rotating shaft 14, and the second end of the second rotating shaft 14 passes through the second channel 18.

To limit the position of the second rotating shaft 14 in the axial direction and prevent the second rotating shaft 14 from coming apart, both ends of the second rotating shaft 14 are each provided with the flange 19. The two flanges 19 are adjacent to the backrest rod 7 and the second sleeve 15, respectively.

In the present embodiment, when the user sits on the armchair and reclines on the backrest, the backrest swings backward around the first rotating shaft 1. The backrest rod 7 drives the second rotating shaft 14 to move along the first channel 17 and the second channel 18, and the spring 10 is compressed by the ends of the connecting member 16 and the second sleeve 15 to provide elastic force for the backrest. When the user rises, the restoring force of the spring 10 urges the backrest to reset.

Figure 5:
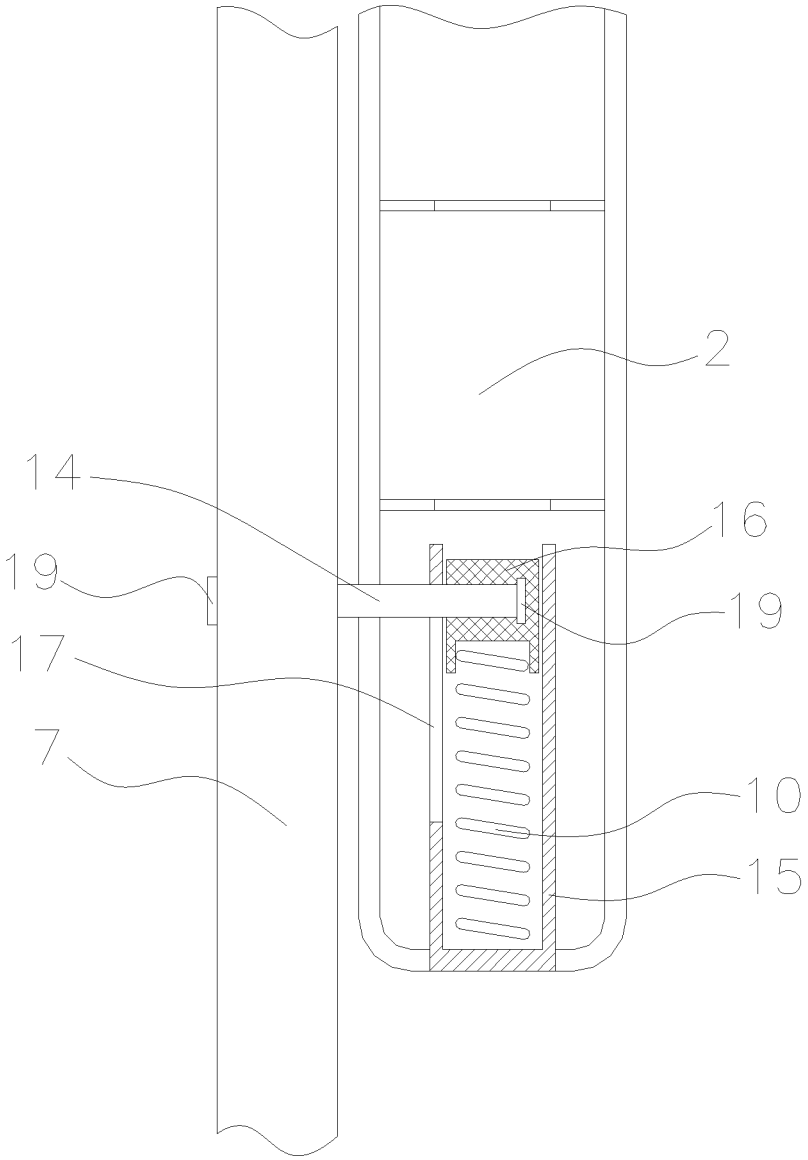
FIG. 5 is a partial structural schematic view of Embodiment 3 of the armchair.

Embodiment 3 is schematically shown in FIG. 5 and differs from Embodiment 2 as follows. The second end of the second rotating shaft 14 does not need to penetrate the connecting member 16, and the second sleeve 15 does not need to be provided with the second channel 18. The connecting member 16 is provided with an annular groove, and the flange 19 at the second end of the second rotating shaft 14 is fitted in the annular groove.

For Embodiment 2 and Embodiment 3, the end of the cylindrical cavity away from the connecting member 16 is closed. The spring 10 abuts against the closed end when in a relaxed or slightly compressed state. To prevent the second rotating shaft 14 and the connecting member 16 from being separated from the second sleeve 15, the first channel 17 and/or the second channel 18 can be configured as waist-type holes. The contour of the waist-type hole is a closed curved surface, and the second rotating shaft 14 is restricted in the waist-type hole. Alternatively, the end of the cylindrical cavity adjacent to the connecting member 16 can also be closed.

Figure 6:
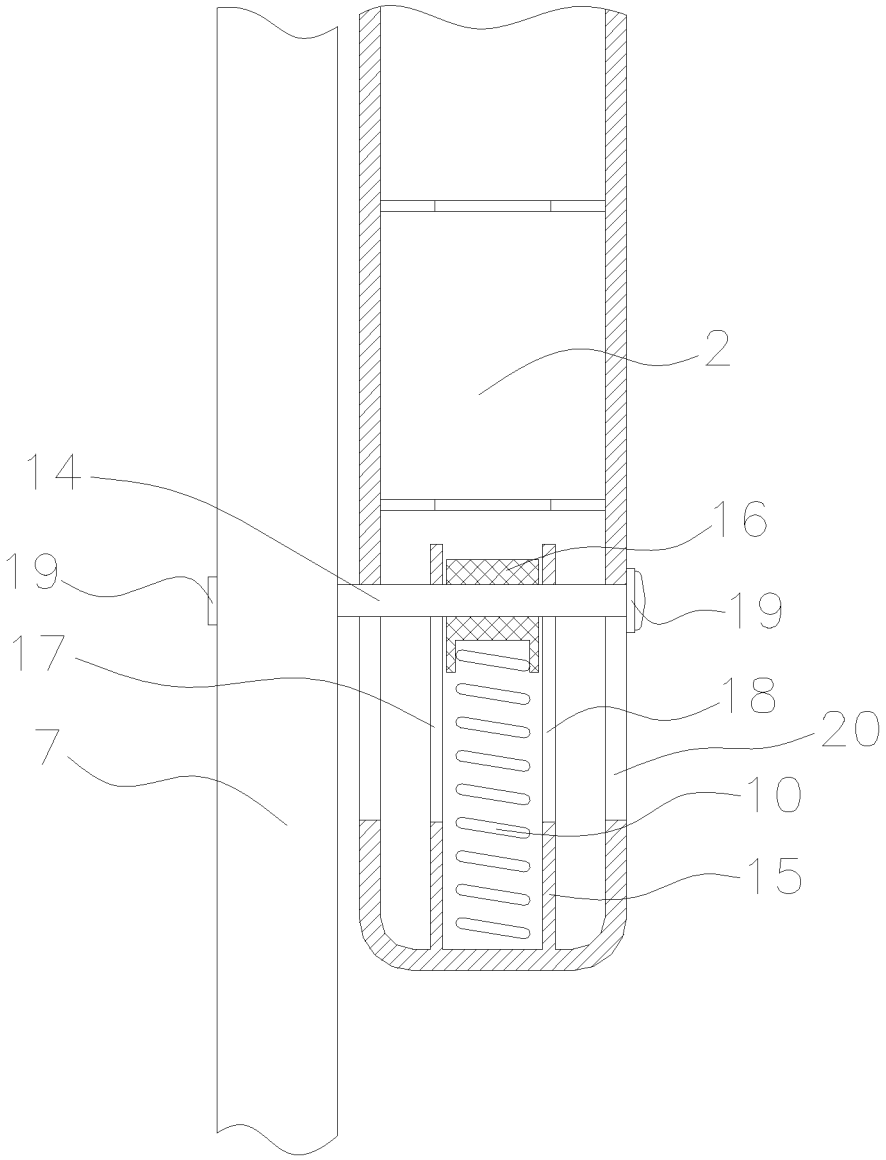
FIG. 6 is a partial structural schematic view of Embodiment 4 of the armchair.

In addition, FIG. 6 schematically shows Embodiment 4, two third channels 20 are symmetrically arranged on the armrest 2. The two third channels 20 correspond to the first channel 17 and the second channel 18, respectively. The length direction of the third channel 20 is parallel to the axis of the spring 10 and perpendicular to the second rotating shaft 14. The first end of the second rotating shaft 14 passes through the third channel 20 and then passes through the backrest rod 7 and forms the flange 19. The second end of the second shaft 14 passes through another third channel 20 and forms the flange 19. In the present embodiment, to prevent the second rotating shaft 14 and the connecting member 16 from being separated from the second sleeve 15, the third channel 20 can be configured as a waist-type hole. Selectively, the first channel 17 and the second channel 18 can be configured as waist-type holes, and the end of the cylindrical cavity adjacent to the connecting member 16 can be closed.

Figure 7:
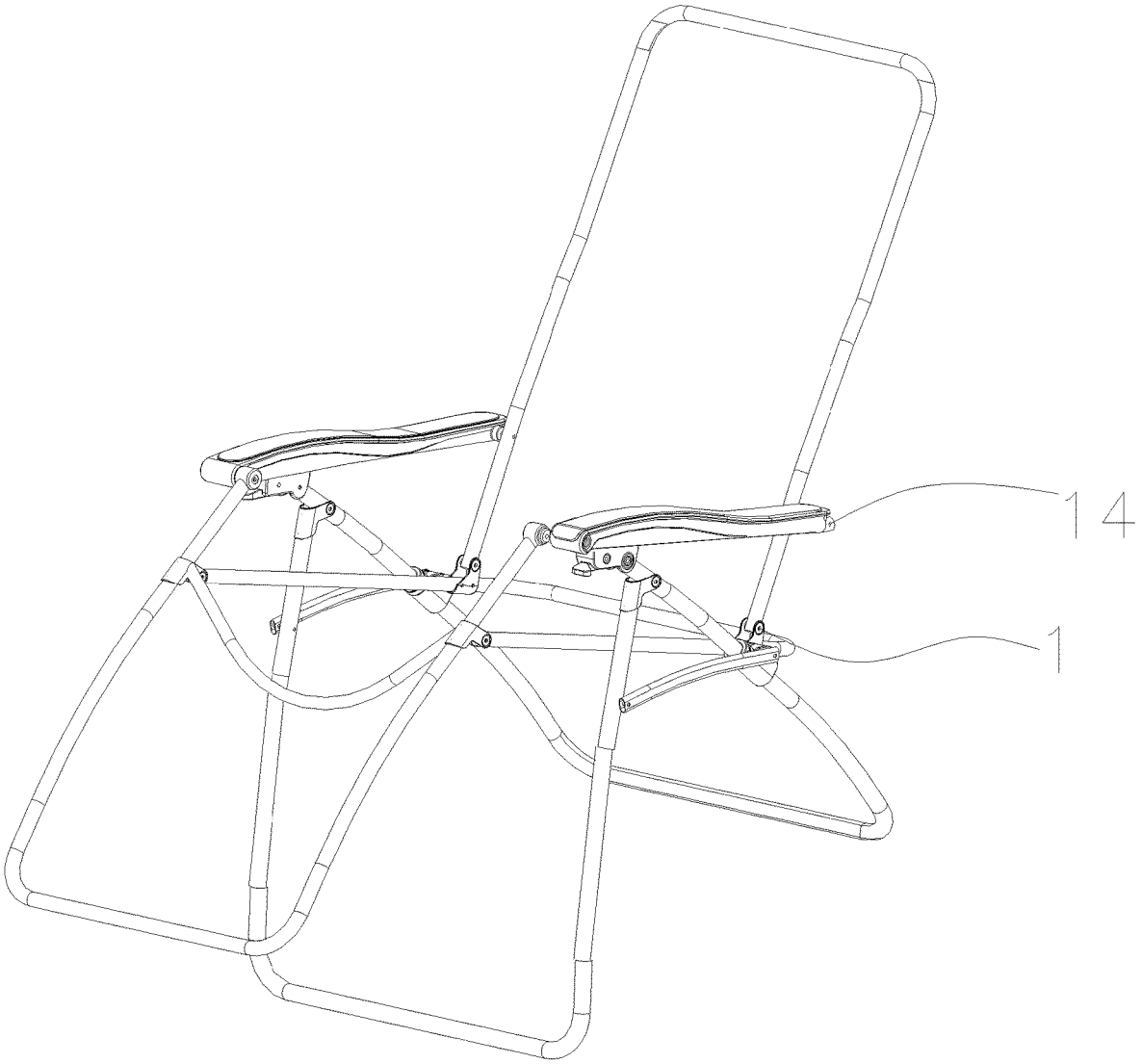
FIG. 7 is a schematic view of the frame structure of an embodiment of the armchair.

FIG. 7 shows an embodiment of a folding chair with the elastic assembly of Embodiment 1, Embodiment 2, Embodiment 3, or Embodiment 4.

Figure 8:
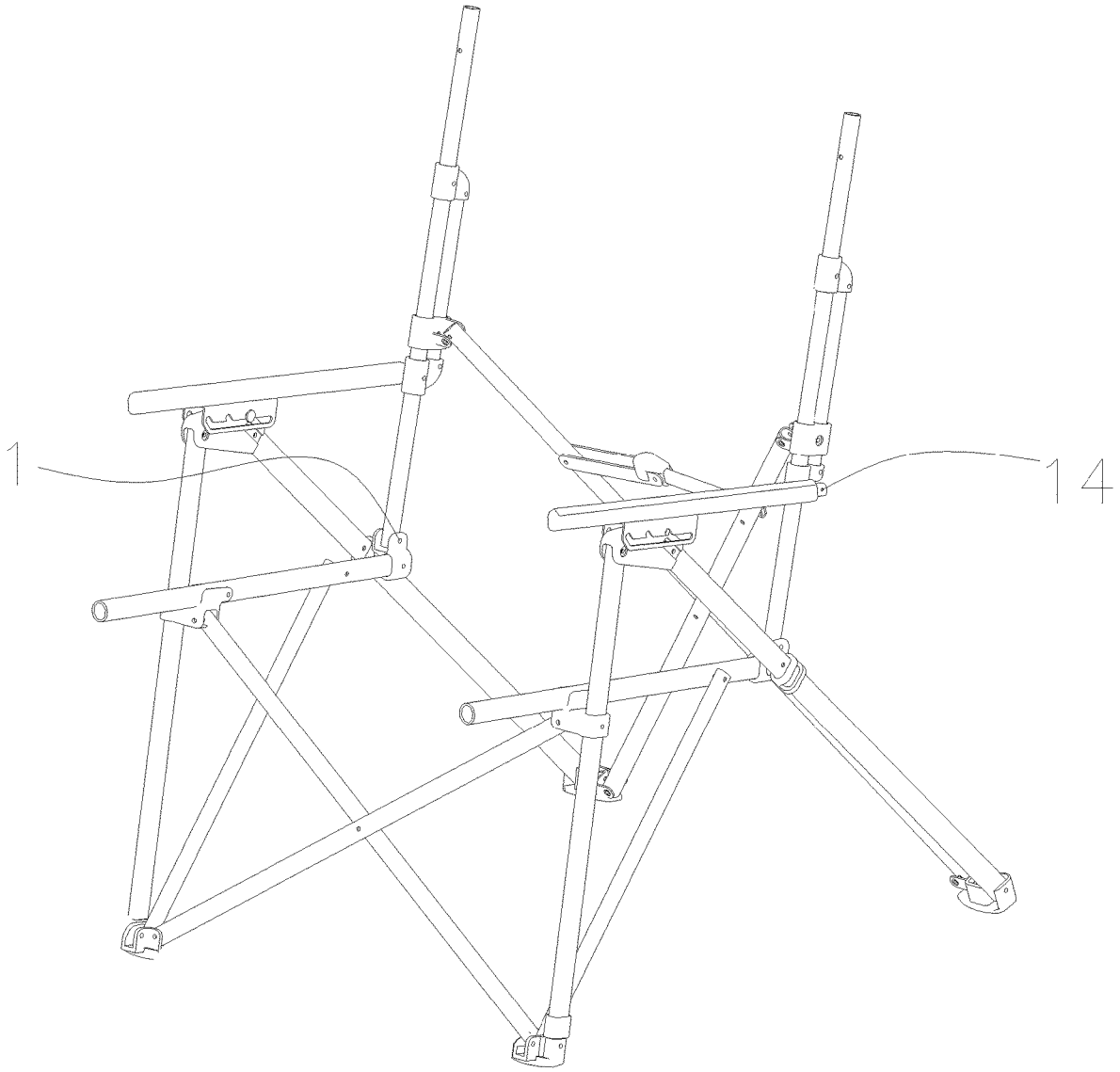
FIG. 8 is a schematic view of the frame structure of another embodiment of the armchair.
Figure 9:
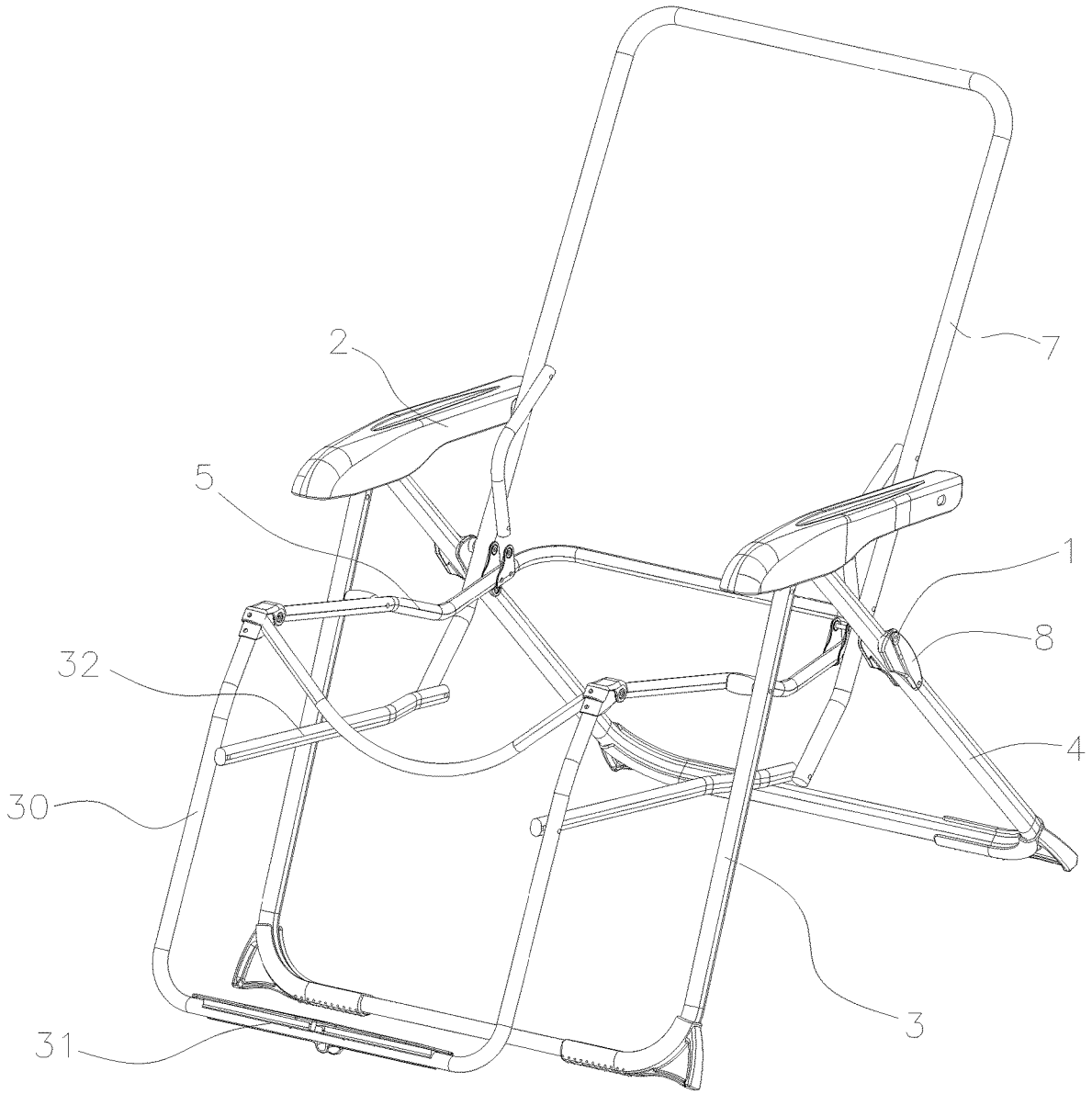
FIG. 9 is a schematic view of the frame structure of Embodiment 5 of the armchair.
Figure 10:
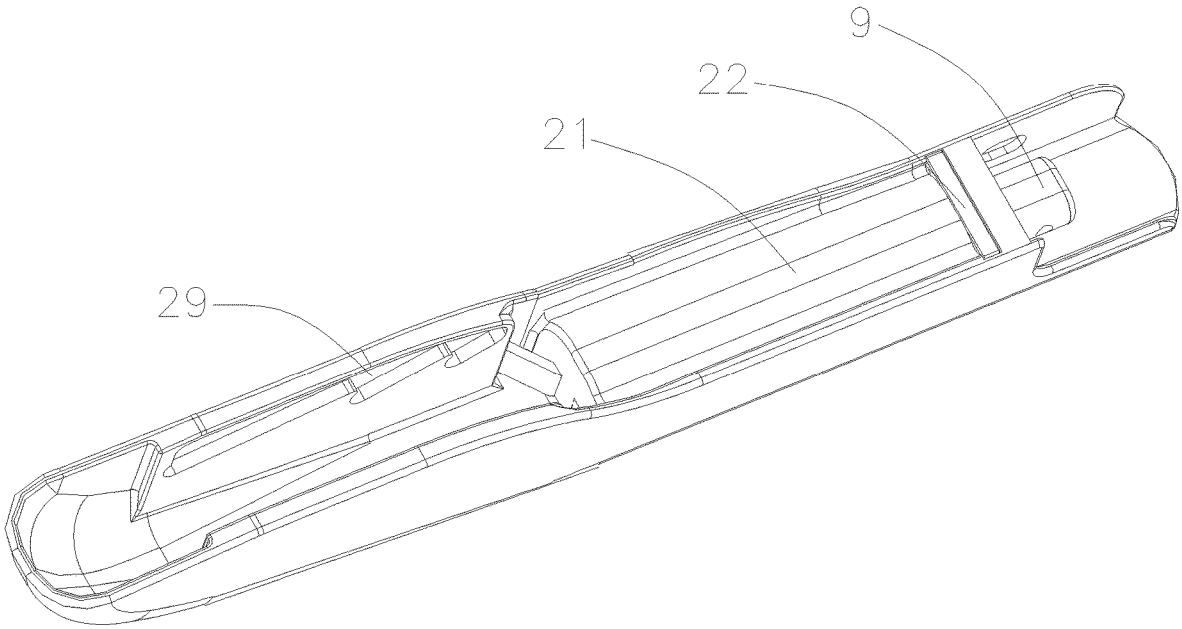
FIG. 10 is a partial structural schematic view of Embodiment 5 of the armchair.
Figure 11:
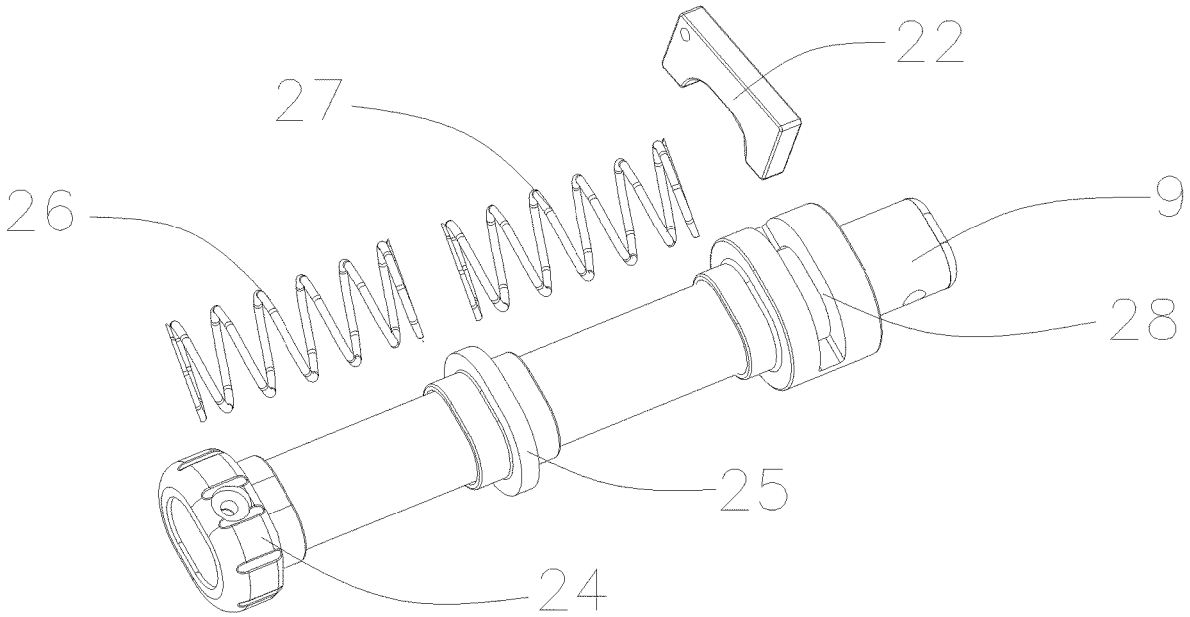
FIG. 11 is a partial exploded view of Embodiment 5 of the armchair.
Figure 12:
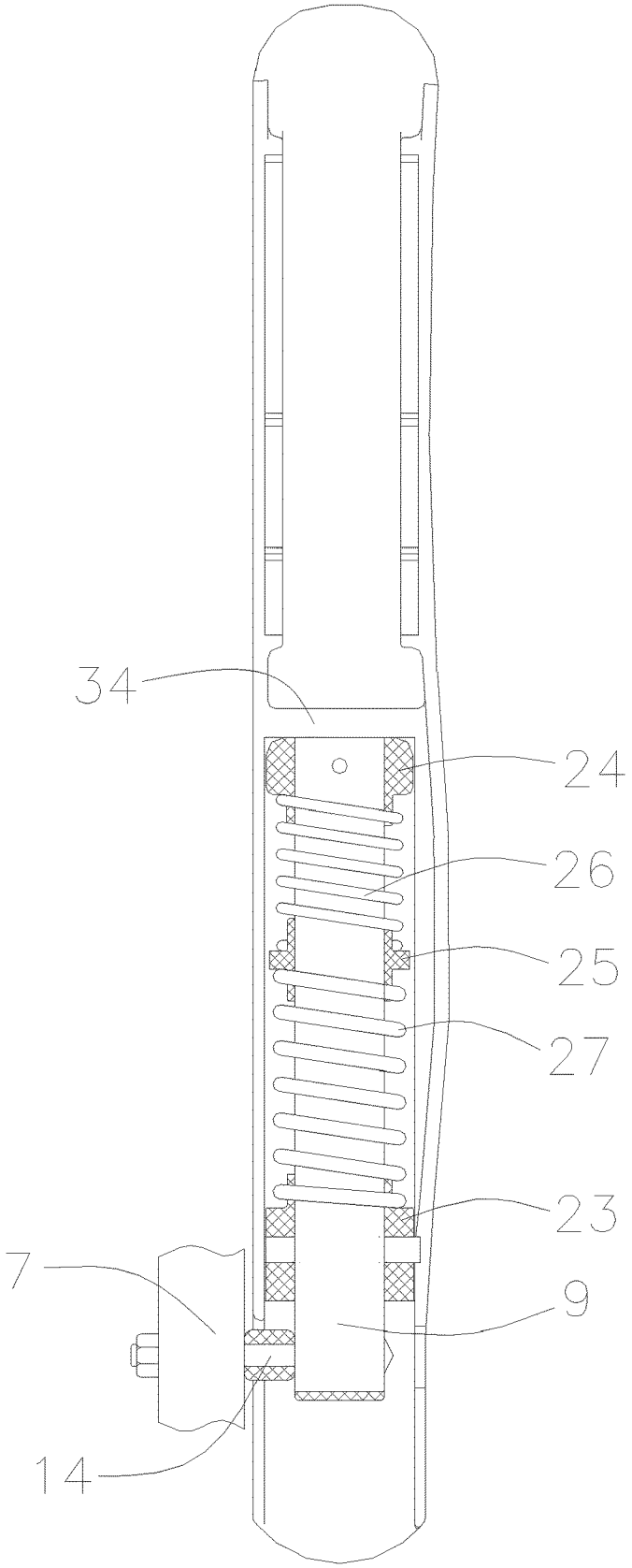
FIG. 12 is a cross-sectional view of the partial structure of Embodiment 5 of the armchair.
Figure 13:
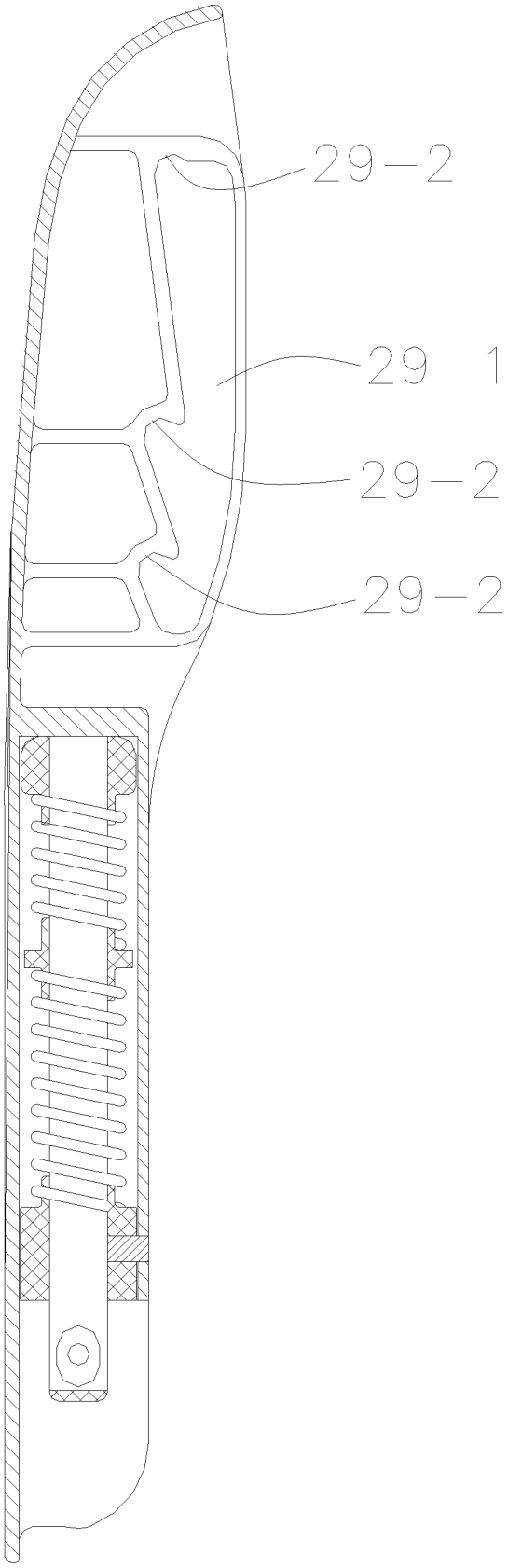
FIG. 13 is another cross-sectional view of the partial structure of Embodiment 5 of the armchair.
Figure 14:
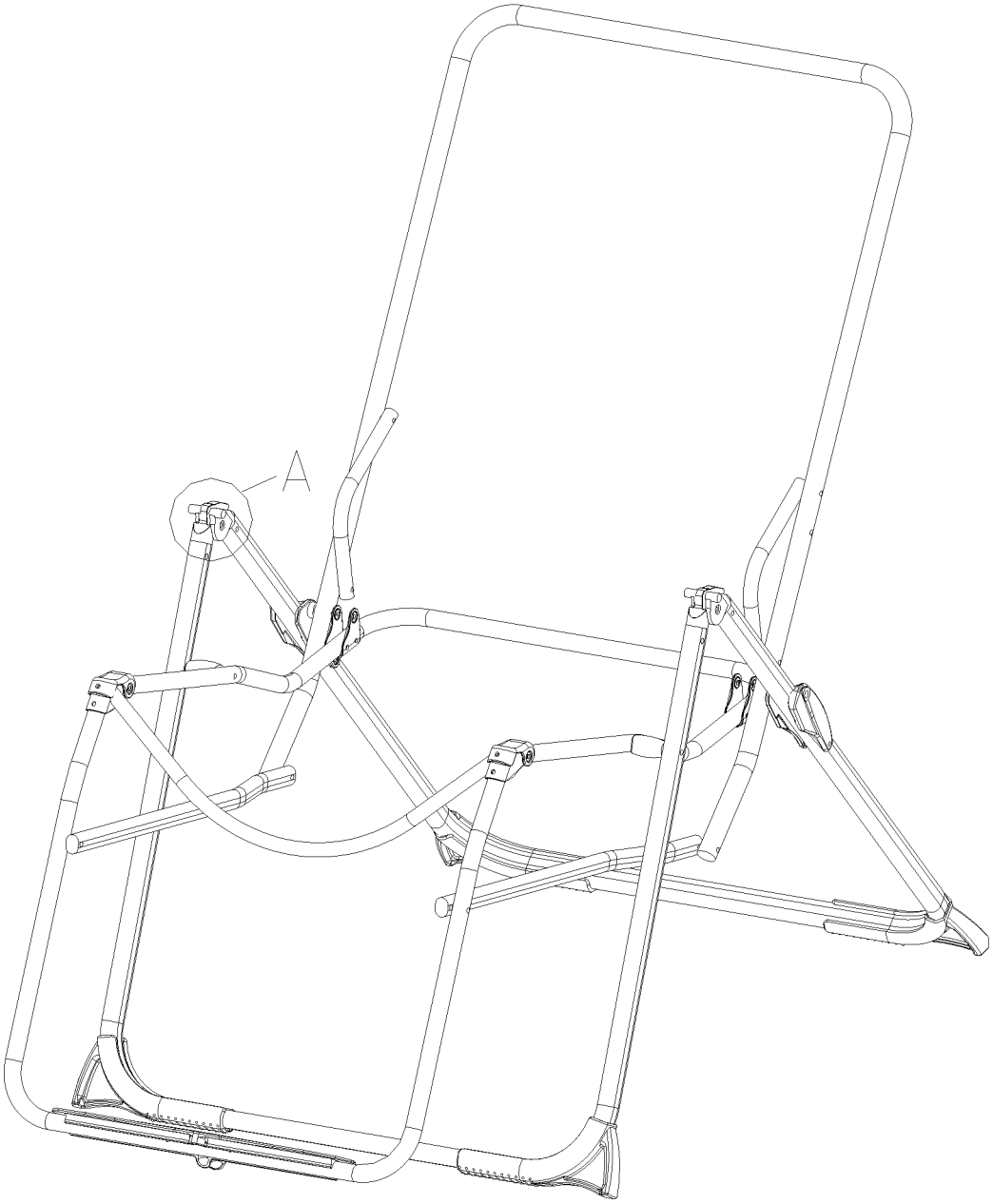
FIG. 14 is a partial schematic view of the frame structure of Embodiment 5 of the armchair.
Figure 15:
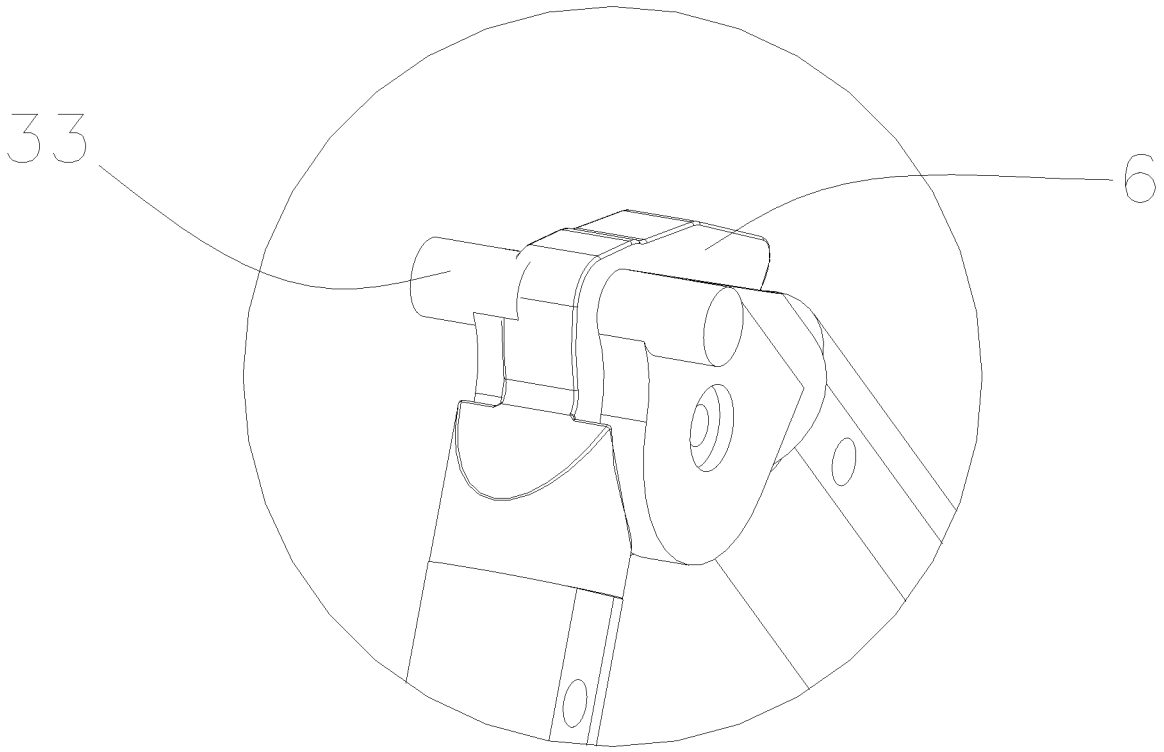
FIG. 15 is an enlarged view of the portion A encircled in FIG. 14.

FIG. 8 shows another embodiment of the folding chair with the elastic assembly of Embodiment 1, Embodiment 2, Embodiment 3, or Embodiment 4.

FIGS. 9-15 schematically show Embodiment 5 of the folding chair, which includes a base, a backrest pivotally connected to the base by the first rotating shaft 1, and the armrest 2 connected to the base. In the present embodiment, the armchair is a folding chair. The base includes the front supporting leg 3, the rear supporting leg 4 and the middle frame 5. The upper ends of the front supporting leg 3 and the rear supporting leg 4 are pivotally connected to the first hinge member 6, and when the armchair is unfolded, the front supporting leg 3 and the rear supporting leg 4 support the armrest 2. The backrest includes two backrest rods 7 symmetrically arranged, and the middle frame 5 is pivotally connected to the front supporting leg 3 and the backrest rod 7, respectively. The second hinge member 8 is pivotally connected to the rear supporting leg 4, and the backrest rod 7 is pivotally connected to the second hinge member 8 by the first rotating shaft 1.

The elastic assembly includes the third sleeve 21, the engaged key 22, the connecting rod 9, the third limiting member 23, the fourth limiting member 24, the fifth limiting member 25, the front spring 26 and the rear spring 27. The third sleeve 21 fixed on the armrest 2 has a cavity. One end of the cavity is an opening, and the other end of the cavity is provided with the blocking member 34. In the present embodiment, the blocking member 34 is part of the third sleeve. In other embodiments, the blocking member 34 can also be independent of the third sleeve and fixedly connected to the third sleeve or other parts of the armrest. The third sleeve 21 is provided with a limiting hole adjacent to the opening, and the third limiting member 23 is provided with the limiting slot 28. One end of the connecting rod 9 is fixedly connected to the fourth limiting member 24 and inserted into the cavity of the third sleeve 21. The other end of the connecting rod 9 passes through the third limiting member 23 and is pivotally connected to the backrest rod 7 by the second rotating shaft 14. After the armchair is unfolded, the second rotating shaft 14 is located above the first rotating shaft 1, and the third limiting member 23 is slidably fitted with the connecting rod 9. The fifth limiting member 25 located between the third limiting member 23 and the fourth limiting member 24 is slidably fitted with the connecting rod 9. The front spring 26 is sleeved on the connecting rod 9 and has two ends that are connected to the fourth limiting member 24 and the fifth limiting member 25, respectively. The rear spring 27 is sleeved on the connecting rod 9 and has two ends that are connected to the third limiting member 23 and the fifth limiting member 25, respectively. The stiffness coefficient of the rear spring 27 is greater than the stiffness coefficient of the front spring 26. In the present embodiment, when the elastic assembly is assembled, the third limiting member 23 is forcibly pressed into the cavity of the third sleeve 21 so that the limiting slot 28 corresponds to the limiting hole, and then the engaged key 22 is inserted into the limiting slot 28 along the limiting hole from the outside of the sleeve to fix the third sleeve 21 and the third limiting member 23. Since the fourth limiting member 24 abuts against the blocking member 34, the front spring 26 and the rear spring 27 are slightly compressed so that the third limiting member 23 and the engaged key 22 obtain a certain pressure to prevent the engaged key 22 from being disengaged from the limiting hole and the limiting groove 28.

When the user sits on this armchair and reclines on the backrest, the backrest is forced to swing, or adjustably recline, backward around the first rotating shaft 1, the connecting rod 9 is pulled out from the opening by the second rotating shaft, and the fourth limiting member 24 also moves toward the opening. Since the third limiting member 23 is fixed, the front spring 26 and the rear spring 27 are compressed to provide elastic force for the backrest. When the user rises, the restoring force of the spring urges the backrest to reset. In the present embodiment, since the stiffness coefficient of the rear spring 27 is greater than the stiffness coefficient of the front spring 26, the deformation of the front spring 26 is greater than the deformation of the rear spring 27 when the front spring 26 and the rear spring 27 are subjected to the same pressure. Therefore, when the user is lighter in weight or sits straightly, the force applied to the backrest is smaller, and the deformation of the rear spring 27 is smaller. At this time, the swing amplitude of the backrest is mainly provided by the deformation of the front spring 26. In this regard, in the present embodiment, the inner wall of the armrest 2 is provided with two symmetrically arranged adjusting cavities 29 enclosed by surfaces to allow users to adjust their sitting posture. The adjusting cavity 29 includes the strip-shaped fourth channel 29-1 and three recesses 29-2 on one side of the fourth channel 29-1. The locking pin 33 is provided on both sides of the first hinge member corresponding to the two adjusting cavities 29, and the locking pin 33 is inserted into the adjusting cavity 29. The opening of the recess 29-2 is inclined toward the backrest. When the locking pin 33 enters the recess 29-2, the backrest pulls the armrest 2 backward to lock the locking pin 33 in the recess 29-2. When the user slightly lifts the armrest 2 forward and upward, the locking pin 33 is released from the recess 29-2 and enters the fourth channel 29-1. At this time, the locking pin 33 can move in the fourth channel 29-1, and the length direction of the fourth channel 29-1 is roughly the front-rear direction, so that the user can move the armrest 2 backward and forward. The movement of the armrest 2 drives the backrest to change the inclined angle significantly. The user moves the armrest 2 forward and slightly presses it down to allow the locking pin 33 to enter the previous recess 29-2. If the user reclines backward while lifting the armrest 2, the armrest 2 is pulled back by the backrest, and the locking pin 33 enters the next recess 29-2. In the present embodiment, the number of the recesses 29-2 is three, corresponding to three different sitting positions of the user, e.g., slightly reclining position, semi-reclining position and supine position. When the backrest is slightly reclined, the back of the user reclines on the backrest. Since the back exerts less force on the backrest, the deformation of the front spring 26 provides a certain swing amplitude for the backrest to provide a cushion for the back of the user, and the deformation of the rear spring 27 is relatively small. When the backrest is semi-reclined or in the supine position, the backrest bears relatively large pressure. When the user is rocking, both the front spring 26 and the rear spring 27 produce larger deformations, and the backrest can swing in a larger amplitude.

In the present embodiment, the folding chair further includes a footrest. The footrest is U-shaped and includes two side supporting rods 30 and the footrest rod 31 connected between the two side supporting rods 30. The upper end of the side supporting rod 30 is pivotally connected to the middle frame 5. The lower end of the backrest rod 7 is connected to the side supporting rod 30 by the linkage rod 32. The two ends of the linkage rod 32 are pivotally connected to the side supporting rod 30 and the backrest rod 7, respectively. The footrest is linked with the backrest by the linkage rod 32. When the backrest is tilted backward, the footrest rod 31 rises; and when the backrest is tilted forward, the footrest 31 lowers down, which provides a more comfortable experience for the user.

Based on the enlightenment from the foregoing ideal embodiments of the present invention and the foregoing description, skilled artisans in the art can make various changes and modifications without departing from the scope of the technical idea of the present invention. The technical scope of the present invention is not limited to the content of the description, and must be defined according to the scope of the claims.

What is claimed is:

1. An armchair, comprising
a base,
a backrest,
an armrest, and
an elastic assembly;
wherein
the backrest is pivotally connected to the base by a first rotating shaft;
the armrest is connected to the base;
the elastic assembly is fixed on the armrest;
the backrest and the elastic assembly are pivotally connected by a second rotating shaft; and
the elastic assembly is configured to provide an elastic force when the backrest swings around the first rotating shaft, wherein,
the elastic assembly comprises a connecting rod, a spring, a first sleeve and a first limiting member;
the first sleeve is fixed on the armrest and has a cavity with an open end and a closed end;
a first end of the connecting rod is pivotally connected to the backrest by the second rotating shaft;
the connecting rod and the backrest are both rotatably connected to the second rotating shaft;
a second end of the connecting rod is fixedly connected to the first limiting member and inserted into the cavity of the first sleeve;
a protrusion is arranged inside the cavity of the first sleeve;
the spring is sleeved on the connecting rod and located between the protrusion and the first limiting member; and
when the first limiting member moves toward the open end, the spring is compressed by the protrusion and the first limiting member.

2. The armchair according to claim 1, wherein,
the elastic assembly further comprises a second limiting member;
the second limiting member is arranged between the first limiting member and the protrusion, and the second limiting member is slidably fitted with the connecting rod;
the spring is located between the first limiting member and the second limiting member; and
when the first limiting member moves toward the open end, the spring is compressed by the first limiting member and the second limiting member, and the protrusion restricts a movement of the second limiting member.

3. The armchair according to claim 2, wherein,
the backrest comprises a backrest rod;
a first end of the backrest rod is pivotally connected to the base by the first rotating shaft;
the first end of the connecting rod is pivotally connected to the backrest rod by the second rotating shaft, and
the second rotating shaft is located between the first end of the backrest rod and a second end of the backrest rod.

4. An armchair, comprising
a base,
a backrest,
an armrest, and
an elastic assembly;
wherein
the backrest is pivotally connected to the base by a first rotating shaft;
the armrest is connected to the base;
the elastic assembly is fixed on the armrest;
the backrest and the elastic assembly are pivotally connected by a second rotating shaft; and
the elastic assembly is configured to provide an elastic force when the backrest swings around the first rotating shaft, wherein,
the elastic assembly comprises a connecting rod, a spring, a first sleeve and a first limiting member;
the first sleeve is fixed on the armrest and has a cavity with an open end and a closed end;
a first end of the connecting rod is pivotally connected to the backrest by the second rotating shaft;

the connecting rod and the backrest are both rotatably connected to the second rotating shaft;

a second end of the connecting rod is fixedly connected to the first limiting member and inserted into the cavity of the first sleeve;

a protrusion is arranged inside the cavity of the first sleeve;

the spring is sleeved on the connecting rod and located between the protrusion and the first limiting member; and when the first limiting member moves toward the open end, the spring is compressed by the protrusion and the first limiting member;

wherein, the elastic assembly further comprises a second sleeve and a connecting member;

the second sleeve is fixed on the armrest and has a cavity, and the spring is arranged in the cavity of the second sleeve;

the connecting member is located at one end of the spring and moves in the cavity along a direction, wherein the spring is compressed and stretched in the direction;

the connecting member is pivotally connected to the backrest by the second rotating shaft, and the connecting member is rotatably connected to the second rotating shaft;

the second sleeve is provided with a first channel, and a length direction of the first channel is parallel to an axis of the spring and perpendicular to the second rotating shaft; and a first end of the second rotating shaft penetrates the connecting member and the first channel, and the first end of the second rotating shaft is rotatably connected to the backrest.

5. The armchair according to claim 4, wherein, the second sleeve is provided with a second channel, wherein the second channel and the first channel are symmetrically arranged; and a second end of the second rotating shaft penetrates the connecting member and the second channel.

6. The armchair according to claim 5, wherein, a contour of at least one of the first channel and the second channel is a closed curved surface.

7. The armchair according to claim 6, wherein, the armrest is provided with two third channels, wherein the two third channels are symmetrically arranged;

the two third channels correspond to the first channel and the second channel, respectively;

a length direction of each third channel of the two third channels is parallel to the axis of the spring and perpendicular to the second rotating shaft; and the first end of the second rotating shaft passes through a left third channel of the two third channels, and the second end of the second rotating shaft passes through a right third channel of the two third channels.

8. The armchair according to claim 7, wherein, a contour of the each third channel is a closed curved surface.

9. The armchair according to claim 8, wherein, the backrest comprises a backrest rod;

a first end of the backrest rod is pivotally connected to the base by the first rotating shaft, and the connecting member is pivotally connected to the backrest rod by the second rotating shaft; and the second rotating shaft is located between the first end of the backrest rod and a second end of the backrest rod.

10. The armchair according to claim 5, wherein, the armrest is provided with two third channels, wherein the two third channels are symmetrically arranged;

the two third channels correspond to the first channel and the second channel, respectively;

a length direction of each third channel of the two third channels is parallel to the axis of the spring and perpendicular to the second rotating shaft; and the first end of the second rotating shaft passes through a left third channel of the two third channels, and the second end of the second rotating shaft passes through a right third channel of the two third channels.

11. The armchair according to claim 10, wherein, a contour of the each third channel is a closed curved surface.

12. The armchair according to claim 11, wherein, the backrest comprises a backrest rod;

a first end of the backrest rod is pivotally connected to the base by the first rotating shaft, and the connecting member is pivotally connected to the backrest rod by the second rotating shaft; and the second rotating shaft is located between the first end of the backrest rod and a second end of the backrest rod.

13. An armchair, comprising a base, a backrest, an armrest, and an elastic assembly;

wherein the backrest is pivotally connected to the base by a first rotating shaft;

the armrest is connected to the base;

the elastic assembly is fixed on the armrest;

the backrest and the elastic assembly are pivotally connected by a second rotating shaft; and the elastic assembly is configured to provide an elastic force when the backrest swings around the first rotating shaft, wherein, the elastic assembly comprises a connecting rod, a spring, a first sleeve and a first limiting member;

the first sleeve is fixed on the armrest and has a cavity with an open end and a closed end;

a first end of the connecting rod is pivotally connected to the backrest by the second rotating shaft;

the connecting rod and the backrest are both rotatably connected to the second rotating shaft;

a second end of the connecting rod is fixedly connected to the first limiting member and inserted into the cavity of the first sleeve;

a protrusion is arranged inside the cavity of the first sleeve;

the spring is sleeved on the connecting rod and located between the protrusion and the first limiting member; and when the first limiting member moves toward the open end, the spring is compressed by the protrusion and the first limiting member; wherein, the elastic assembly further comprises a second limiting member;

the second limiting member is arranged between the first limiting member and the protrusion, and the second limiting member is slidably fitted with the connecting rod;

the spring is located between the first limiting member and the second limiting member; and when the first limiting member moves toward the open end, the spring is compressed by the first limiting member and the second limiting member, and the protrusion restricts a movement of the second limiting member;

wherein, the elastic assembly further comprises a second sleeve, a third limiting member, a fourth limiting member, a fifth limiting member, a front spring and a rear spring;

the third limiting member is fixedly connected to the armrest;

a first end of the connecting rod is pivotally connected to the backrest by the second rotating shaft;

a second end of the connecting rod passes through the third limiting member and is fixedly connected to the fourth limiting member;

the third limiting member is slidably fitted with the connecting rod;

the fifth limiting member is located between the third limiting member and the fourth limiting member and slidably fitted with the connecting rod;

the front spring is sleeved on the connecting rod and located between the fourth limiting member and the fifth limiting member;

the rear spring is sleeved on the connecting rod and located between the third limiting member and the fifth limiting member;

a stiffness coefficient of the rear spring is greater than a stiffness coefficient of the front spring; and when the fourth limiting member moves toward the third limiting member, the front spring is compressed by the fourth limiting member and the fifth limiting member, and the rear spring is compressed by the fifth limiting member and the third limiting member.

14. The armchair according to claim 13, wherein, the armrest has a first adjusting part, and the base comprises a second adjusting part, wherein the second adjusting part is connected to the first adjusting part;

the first adjusting part cooperates with the second adjusting part, and the armrest moves relative to the base and is locked at a plurality of positions; and the backrest is linked with the armrest; when the armrest is locked at the plurality of positions, the backrest rotates to inclined angles corresponding to the plurality of positions.

15. The armchair according to claim 14, wherein, the second adjusting part is a locking pin, and the first adjusting part has an adjusting cavity, wherein the adjusting cavity is enclosed by a surface;

the locking pin is inserted into the adjusting cavity;

the adjusting cavity comprises a fourth channel and a plurality of recesses; wherein the locking pin moves in the fourth channel, and the locking pin is embedded in the plurality of recesses; and a surface forming the plurality of recesses is configured to lock the locking pin.

16. The armchair according to claim 15, wherein, the elastic assembly further comprises a third sleeve and an engaged key;

the third sleeve is fixed on the armrest and has a cavity;

a first end of the cavity of the third sleeve is an opening, and a second end of the cavity of the third sleeve is provided with a blocking member;

the third sleeve is provided with a limiting hole adjacent to the opening, and the third limiting member is provided with a limiting slot; and the second end of the connecting rod is fixed to the fourth limiting member and inserted into the cavity of the third sleeve from the opening and stopped by the blocking member; and the engaged key is inserted into the limiting hole and the limiting slot.

17. The armchair according to claim 16, wherein, the backrest comprises a backrest rod, and the backrest rod is pivotally connected to the base by the first rotating shaft; and the first end of the connecting rod is pivotally connected to the backrest rod by the second rotating shaft.

18. The armchair according to claim 17, further comprising a footrest, wherein the footrest comprises a side supporting rod, wherein an end of the side supporting rod is pivotally connected to the base;

an end of the backrest rod is connected to the side supporting rod by a linkage rod, and both ends of the linkage rod are pivotally connected to the side supporting rod and the backrest rod, respectively.

* * * * *